United States Patent [19]

Naka

[11] Patent Number: 4,619,086

[45] Date of Patent: Oct. 28, 1986

[54] CEILING CONSTRUCTION

[75] Inventor: Hiromitsu Naka, Yashio, Japan

[73] Assignee: Kabushiki Kaisha Naka Gijutsu Kenkyusho, Tokyo, Japan

[21] Appl. No.: 515,265

[22] Filed: Jul. 19, 1983

[30] Foreign Application Priority Data

Jul. 11, 1983 [JP] Japan ..... 57-127259

[51] Int. Cl.[4] ..... E04B 5/52

[52] U.S. Cl. ..... 52/205; 52/213; 52/484; 52/204

[58] Field of Search ..... 52/205, 208, 213, 214, 52/656, 196, 489, 488, 669, 665, 28, 210, 204; 98/40 DL, 40 D

[56] References Cited

U.S. PATENT DOCUMENTS

| | | | |
|---|---|---|---|
| 2,822,584 | 2/1958 | Urbain | 52/488 |
| 2,913,571 | 11/1959 | Smith | 98/40 DL |
| 3,121,259 | 2/1964 | Versen | 52/28 |
| 3,397,499 | 8/1968 | Ward | 52/665 |
| 3,743,826 | 7/1973 | Halfaker | 98/40 DL |
| 4,103,948 | 8/1978 | Naka | 292/258 X |
| 4,439,972 | 2/1979 | Naka | 52/208 |

FOREIGN PATENT DOCUMENTS

| | | | |
|---|---|---|---|
| 2719296 | 11/1977 | Fed. Rep. of Germany | 52/488 |
| 1352258 | 12/1964 | France | 52/200 |

*Primary Examiner*—Henry E. Raduazo

*Attorney, Agent, or Firm*—Wenderoth, Lind & Ponack

[57] ABSTRACT

A ceiling construction for buildings has a plurality of flanged main beams disposed in a predetermined spaced relationship to each other and bridging wall mouldings opposed and spaced from each other; a plurality of flanged cross beams connected to the main beams in a predetermined spaced relationship to each other at right angles to the main beams so as to form a ceiling framework; a ceiling wall mounted on the ceiling framework so as to form an access opening in a predetermined position; a pair of auxiliary beams; a plurality of fastening devices for the auxiliary beams; an access door; and a plurality of mounting devices for the access door. The pair of auxiliary beams each is bridged in a predetermined relationship to flanges the opposite main beams of the main beams adjacent to and spaced from each other or flanges of the opposite cross beams of the cross beams adjacent to and spaced from each other in the access opening on the ceiling wall. Further, the opposite ends of the auxiliary beams are secured to one of the main and cross beams by the fastening devices. Furthermore, the access door is positioned in the access opening, and is secured to the ceiling frame work by the use of the auxiliary beams and mounting devices.

5 Claims, 13 Drawing Figures

CEILING CONSTRUCTION

BACKGROUND OF THE INVENTION

This invention relates to a ceiling construction for buildings and more particularly, to an improved ceiling construction having a ceiling framework which comprises a plurality of main beams and a plurality of cross beams.

Within recent years, ceiling constructions erected by the exposed, concealed and dry wall construction methods have been popularized.

The ceiling framework of the ceiling construction erected by any one of the three known construction methods comprises a grid system which comprises a plurality of flanged main beams and a plurality of flanged cross beams interconnected at right angles to each other to form a grid formation. In the ceiling construction erected by the exposed construction method, the ceiling boards which constitute the ceiling wall are fitted in the grid and laid on the flanges on the main and cross beams in the grid. In the ceiling construction erected by the concealed construction method, the ceiling boards which constitute the ceiling wall are positioned in the grid with the flanges on the main beams received in the grooves formed in the end faces of the ceiling boards. In the ceiling construction erected by the dry wall construction method, the ceiling boards which constitute the ceiling wall are secured to the main and cross beams by means of nails or screws in the grid. The ceiling construction usually includes an access door, but in the ceiling construction erected by the exposed construction method, since the ceiling boards can be easily removed, such a ceiling construction is not provided with the access door. In the ceiling construction erected by the concealed construction method, the ceiling boards are mounted on the main beams by the employment of access angles and hooks in suitable positions on the ceiling whereby the ceiling boards can be removed and thus, as in the case of the ceiling construction erected by the exposed construction method, in the ceiling construction erected by the concealed construction method, the access door is not usually employed. However, when the ceiling boards are designed to be removed, as the ceiling boards are removed and reinstated, the ceiling boards tend to be damaged or smeared leading to undesirable results.

In the ceiling construction erected by the dry wall construction method, since the ceiling boards are not detachable, the access door is disposed in the access opening formed in a suitable position of the ceiling surface. In such a case, taking the weight of the access door into consideration, the access door is attached to the frame channel bound to hanger wires secured to the ceiling slabs by wire fasteners or attached to the frame channel bound to the main beams. In such an access door mounting arrangement, the construction method of the ceiling construction is very troublesome. Especially, when the frame channel is directly hung from the ceiling slabs and the access door is attached to the frame channel, after a prolonged use of the ceiling construction, an undesirable step is formed between the access door and ceiling wall.

SUMMARY OF THE INVENTION

Therefore, one object of the present invention is to provide a ceiling construction for buildings which can be easily erected by the exposed, concealed or dry wall construction method.

Another object of the present invention is to provide a ceiling construction for buildings which is reinforced and is prevented from warping both in the horizontal and vertical directions under the load of the access door as the access door is opened and closed, and which prevents any strain or deflection in the grids of the ceiling construction.

A further object of the present invention is to provide a ceiling construction for buildings which allows the access door to open and close smoothly, in which when the access opening where the access door is positioned opens to the ceiling wall, the ceiling wall is prevented from lifting from the ceiling framework of the ceiling construction, which can be easily applied to the ceiling wall of different thicknesses and materials, and which can be easily and simply constructed in a brief period, and has an improved finish.

For attaining the above objects, the present invention provides a ceiling construction for buildings which comprises a plurality of flanged main beams disposed in a predetermined spaced relationship to each other and bridging wall mouldings opposed and spaced from each other;

a plurality of flanged cross beam connected to said main beams in a predetermined spaced relationship to each other at right angles to the main beams so as to form a ceiling framework;

a ceiling wall mounted on said ceiling framework so as to form an access opening in a predetermined position;

a pair of auxiliary beams each bridging in a predetermined relationship flanges of the opposite main beams of said main beams adjacent to and spaced from each other or flanges of the opposite cross beams of said cross beams adjacent to and spaced from each other in said access opening on said ceiling wall;

a plurality of fastening means securing the opposite ends of said auxiliary beams to one of said main and cross beams;

an access door positioned in said access opening and comprising a stationary framework having an outwardly extending flange, a movable framework rotatably connected to said stationary framework and a cover plate fixedly secured to said movable framework; and a plurality of mounting means securing said access door to said ceiling framework so as to put the access door opening defining edge of the ceiling wall between said auxiliary beams and said outwardly extending flanges on the stationary framework.

The advantages offered by the invention are mainly that various construction methods such as the exposed, concealed and dry wall construction methods can be easily applied, that the ceiling is reinforced and reduced in weight, that even through the weight of the ceiling is reduced the ceiling is prevented from warping in the horizontal and vertical directions under the load of the access door, that any strain or deflection in grids of the ceiling framework is prevented and that especially, if the access door is suddenly opened and closed, any flapping phenomenon or vibration of the ceiling under the load of the access door is prevented. Therefore, the ceiling construction for buildings which has the above-described arrangement of the components is of practical use.

Thus, since the ceiling construction of the present invention is provided with reinforcing means, the ceiling construction is versatilely erected by the exposed, concealed and dry wall construction methods and especially, very suitable for a broad building ceiling.

BRIEF DESCRIPTION OF THE DRAWINGS

The aforementioned and other objects and attendant advantages of the present invention will be more readily apparent to those skilled in the art from the following description when read in connection with the accompanying drawings, in which.

DETAILED DESCRIPTION OF THE INVENTION

Figure 1:
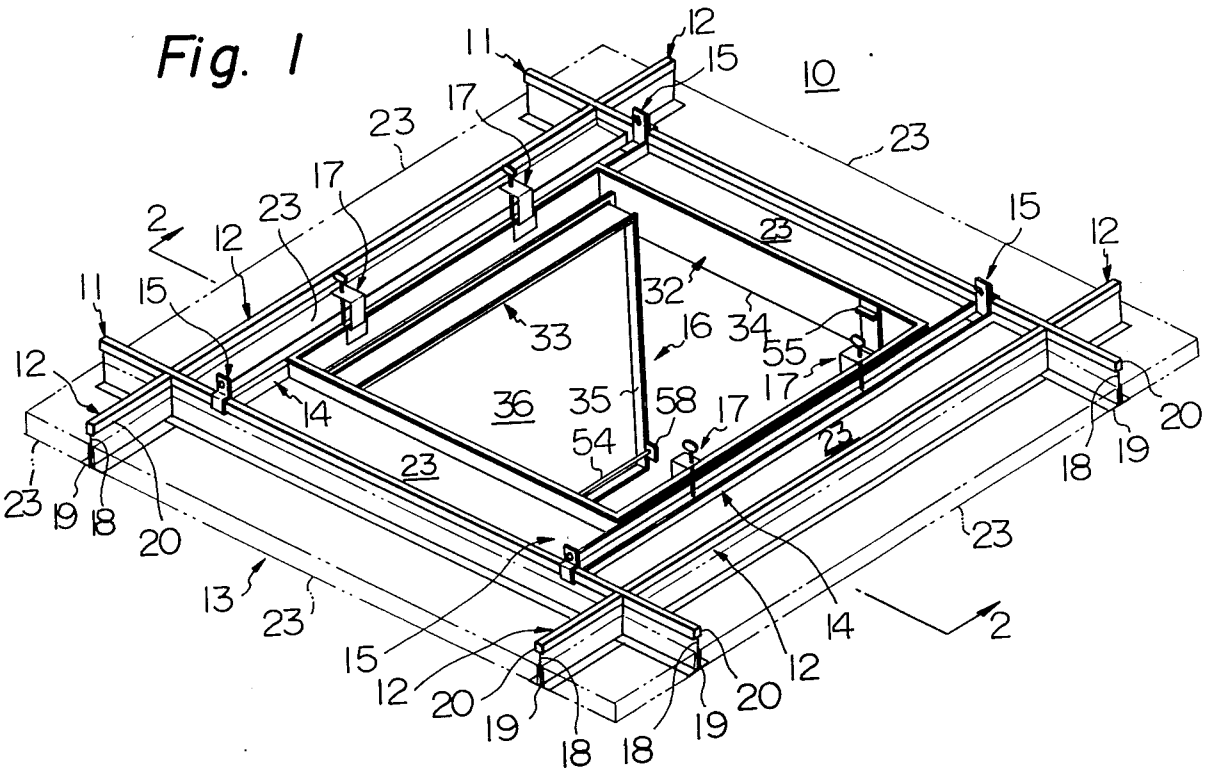
FIG. 1 is a fragmentary perspective view of the preferred embodiment of the ceiling construction erected by the exposed construction method according to the present invention and as applied to a building.
Figure 2:
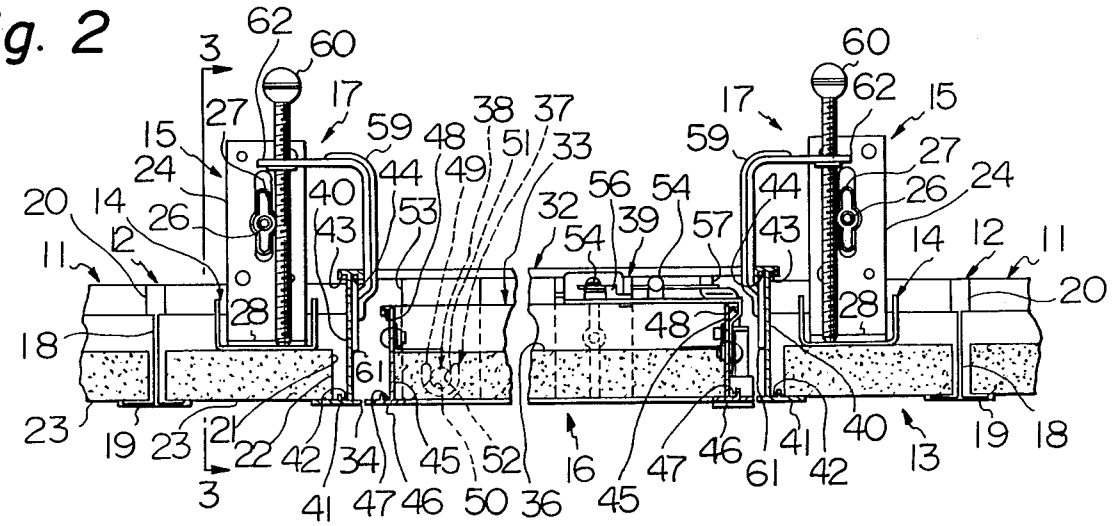
FIG. 2 is a cross-sectional view taken along substantially the line 2—2 of FIG. 1.
Figure 3:
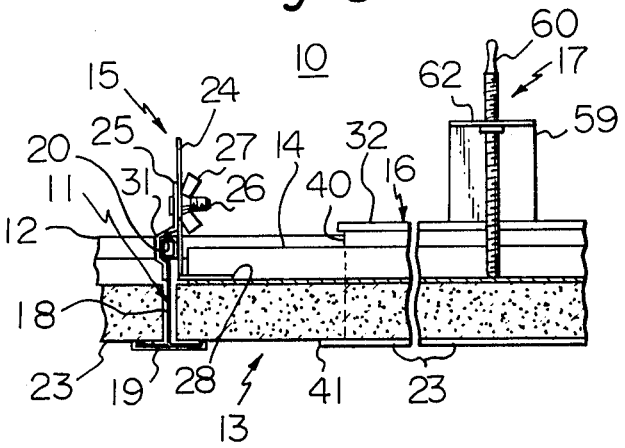
FIG. 3 is a cross-sectional view taken along substantially the line 3—3 of FIG. 2.
Figure 4:
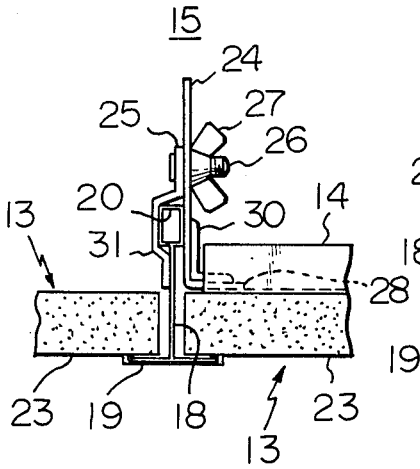
FIG. 4 is fragmentary side elevational view on an enlarged scale of the preferred fastening means employed in the ceiling structure as shown in FIGS. 1 through 3.
Figure 5:
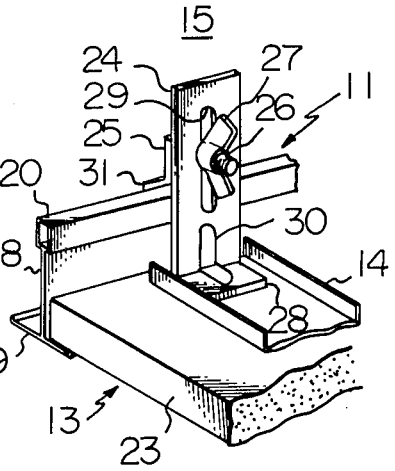
FIG. 5 is a perspective view of the preferred fastening means as shown in FIG. 4.

The present invention will be now described referring to the accompanying drawings and more particularly, to FIGS. 1 through 5 in which the preferred embodiment of the ceiling construction for buildings erected in accordance with the present invention is shown in a fragmentary perspective view.

The ceiling construction 10 is erected by the exposed construction method and in a predetermined spaced relationship the opposite wall mouldings (not shown) secured to the ceiling wall of a building in a square arrangement and hung in suitably spaced positions on the ceiling slabs by means of hanger wires or hanger rods (not shown), a plurality of cross beams 12 extending between the main beams 11 and connected to the main beams 11 in a predetermined spaced relationship and also extending between and connected to the main beams 11 and the associated wall mouldings at right angles thereto so as to form a square ceiling framework, a ceiling wall 13 laid on the flanges of the main and cross beams 11, 12 in the ceiling framework to define an access opening 21 in a selected grid of the ceiling framework, a pair of auxiliary beams 14 disposed on the inner surface of the ceiling wall 13 in the access opening 21 and bridging in a predetermined spaced relationship the flanges of one pair of opposite main beams 11 of the main beams 11, four fastening means 15 securing the auxiliary beams 14 at their opposite ends to the pair of opposite main beams 11, an access door 16 positioned in the access opening 21 and four mounting means 17 securing the access door 16 to the ceiling framework so as to sandwich the access opening defining edge 22 of the ceiling wall 13 between the auxiliary beams 14 and access door 16.

The main beam 11 is formed by rolling a length of metal band such as band steel, aluminum alloy or stainless steel having a T-shaped cross-section and has end couplings (not shown) at the opposite ends. A number of the rolled metal bands are end to end connected by the end couplings to form the main beam having a suitable length depending upon the dimensions of the building ceiling.

Similarly, the cross beam 12 is formed by rolling a length of metal band such as band steel, aluminum alloy or stainless steel having a T-shaped cross-section and has a length in conformity with the span between the opposite main beams 11 or between one main beam 11 and the adjacent wall moulding and the cross beam 12 has twisted clips or hook clips (not shown) at the opposite ends so that the cross beam 12 can be connected to the associated main beams 11 or the adjacent main beam 11 and wall moulding.

The ceiling wall 13 is formed by arranging in succession a plurality of ceiling tiles 23 cut to a desired size between the flanges 19 on the main and cross beams 11, 12 and between one of the main beams 11 or cross beams 12 and the adjacent wall moulding.

The material of the ceiling tile 23 is, of course, selected depending upon the specification of the tile and may be replaced by a cement board having heat-resisting fiber mixed therewith, a wooden board or a board having sound absorption material mixed therewith.

Each of the pair of auxiliary beams 14 is formed of a length of I-cross section steel piece slightly shorter than the span between the opposite main beams 11. The auxiliary beam 14 may be, of course, formed by rolling a length of band steel.

The fastening means 15 comprises a pressure plate 24 urging the auxiliary beam 14 at the adjacent end thereof as well as the adjacent ceiling wall 13 against the flange 19 on the associated main beam 11, a clamping plate 25 securing the pressure plate 24 to the web 18 of the associated main beam 11 and a headed screw and wing nut arrangement 26, 27 securing the clamping plate 25 to the pressure plate 24.

The pressure plate 24 is formed at the lower end with a horizontally bent foot 28 and at the upper end with an elongated slot 29. The bent portion of the foot 28 is reinforced with a bead 30.

The clamping plate 25 is adapted to be employed in abutment against the pressure plate 24 and formed at the lower end with a hook 31 for engaging a rectangular bulb 20 on the associated main beam 11 and at the upper end with a hole (not shown) for receiving the headed screw 26.

The access door 16 is fitted in the access opening 21 and comprises a stationary framework 32 secured to the ceiling framework by mounting means 17 in cooperation the ceiling wall 13 and auxiliary beams 14, a movable framework 33 disposed within the opening 34 defined by the stationary framework 32 and secured to the stationary framework 32 for rotation relative to the stationary framework 32, a cover plate 36 fixedly secured to the movable framework 33 by means of set screws for normally closing the opening 35 defined by the movable framework 33, a pair of bearings 37 projecting inwardly or towards each other from the opposite inner surfaces of the stationary framework 32, a pair of shafts 38 extending through the opposite sides of the movable framework 32 and journalled in the bearings 37 and a cremorne lock 39. With the above-mentioned arrangement of the components of the access door 16, when the movable framework and cover plate assembly 33, 36 and more particularly, the cover plate 36 is in the closed position, the cover plate 36 is locked to the stationary framework 32 by the cremorne lock 39. When the cremorne lock 39 is unlocked, the cover plate 36 is allowed to rotate downwardly to the open position by means of the bearings 37 and shafts 38.

The stationary framework 32 comprises four identical extruded aluminum frame members cut to a selected length and assembled in a square arrangement. More particularly, each of the four frame members of the stationary framework 32 includes a web 40 and an outwardly extending flange 41 integrally formed with the lower end of the web 40 to define the opening 34. The web 40 and flange 41 define lower and upper grooves 42, 43, 44 at the lower end upper ends of the frame member, respectively, for the purpose to be described hereinafter. The stationary framework 32 is, of course, formed by assembling four identical frame members of a selected length each including the web, the flange integrally formed with the upper end of the web and defining grooves on the opposite sides of the web and the flange integrally formed with the lower end of the web and defining a groove on one side of the web together by the use of four identical steel corner pieces at the four corners of the stationary framework 32.

Similarly, the movable framework 33 comprises four identical extruded aluminum alloy frame members cut to a selected length and assembled in a square arrangement. More particularly, each of the four frame members of the movable framework 33 includes a web 45 and an outwardly extending flange 46 integrally formed with the lower end of the web to define the opening 35. The web 45 and flange 46 define lower and upper grooves 47, 48 at the lower end upper ends of the frame member on one side thereof. The movable framework 33 is, of course, formed by assembling four identical frame members of a selected length each including the web and the flange integrally formed with the lower end of the web to define lower end upper grooves on one side of the frame member and held together by the use of four identical steel corner pieces at the four corners of the movable framework.

The cover plate 36 comprises some of the ceiling tiles 23 and is laid on the inside of the outwardly extending flanges 46 of the movable framework 33. The cover plate 36 is fixedly secured to the movable framework 33 by means of a plurality of securing means and screw arrangement.

Each of the bearings 37 includes a substantially U-shaped bearing face 50 with a bearing groove 49 and a pair of inward bulges 52 of small dimensions in the upper opening 51 of the bearing groove 49.

The provision of the pair of inward bulges 52 on the bearing face 50 narrows the upper opening 51 of the bearing groove 49 and thus, the associated shaft 38 is snapped into and out of the bearing 37.

Furthermore, the bearing 37 includes a plate-like bracket 53 integrally formed with one end thereof so that the bearing 37 can be easily attached to the stationary framework 32 whereas the other end of the bearing 37 is positioned adjacent to the web 45 of the adjacent frame member of the movable framework 33. The lower portion of the bearing 37 forms a stop for the outwardly extending flanges 46 of the movable framework 33 and the end face at the other end of the bearing 37 serves to prevent the rocking of the movable framework 33.

The bearing 37 is usually integrally formed together with the bracket 53 from polyamide resin or fluorinated resin, but can be also formed of bearing alloy.

Each of the pair of shafts 38 is provided at one end with a sleeve of reduced outer diameter to extend through the pin hole formed in the adjacent corner piece associated with the movable framework 33. The extended sleeve is caulked against the corner piece and secured thereto.

Thus, when the movable framework 33 is formed of the four frame members and the four corner pieces including the corner piece against which the shaft 38 is caulked, the shafts 38 is attached to the movable framework 33.

The cremorne lock 39 is disposed on the movable framework 33 and comprises a pair of locking rods 54 having the leading ends guided by guides 58 for extending from the movable framework 33 to the stationary framework 32 and vice versa, a pair of rod bearings 55 disposed on the stationary framework 32 for receiving the leading ends of the locking rods 54, an operation plate 56 rotatably held on the cover plate 36 and connecting the locking rods 54 together and a crank shaft 57 for rotating the operation plate 56 from outside of the cover plate 36. The cremorne lock 39 is conventional.

And the cremorne lock 39 may be replaced by any other conventional locking device.

Each of the securing means 17 comprises a carrier plate 59 holding the access door 16 or stationary framework 32 on the associated auxiliary beam 14 and a threaded clamping bar 60 securing the carrier plate 59 to the auxiliary beam 14 so as to sandwich the access opening defining edge 22 of the ceiling wall 13 between the associated auxiliary beam 14 and the outwardly extending flange 41 of the adjacent frame member of the stationary framework 32.

The carrier plate 59 extends along the inner surface of the web 40 of the adjacent frame member of the stationary framework 32 and includes at the lower end a plate like hook 61 to be received in the groove 44 in the adjacent stationary framework frame member and at the upper end a bent arm 62. The arm 62 has a threaded hole (not shown) for receiving the associated threaded clamping bar 60. Thus, the carrier plate 59 and threaded clamping bar 60 are previously assembled together so that the access door 16 can be easily secured to the movable framework 33.

The assembly of the ceiling construction 10 having the afore-mentioned construction and arrangement of the components will be now described. First of all, the wall mouldings are attached to the concrete ceiling wall of a room in a building in accordance with a predetermined layout by the use of concrete nails, a plurality of wire fasteners are driven into the ceiling slabs in a suitably spaced relationship and hanger wires are hooked to the wire fasteners.

Thereafter, a plurality of main beams 11 each comprising a number of beam members end to end connected by the end couplings at the ends of the members to a predetermined length are bridged in a spaced relationship between the respectively adjacent wall mouldings in one plane, the main beams 11 are bound to the hanger wires and the main beams 11 are secured at the opposite ends to the wall mouldings by screws.

Thereafter, a plurality of cross beams 12 are bridged in a spaced relationship between the opposing main beams 11 and between the associated main beams 11 and wall mouldings at right angles to the main beams 11, and the cross beams 12 are connected to the main beams 11 by the twisted clips and to the wall mouldings by the screws to thereby form a grid-shaped ceiling framework.

After the ceiling framework has been formed by the wall mouldings, main beams 11 and cross beams 12 in the manner described hereinabove, a plurality of ceiling tiles 23 of suitable shape are in succession arranged between the flanges 19 on the opposing main beams 11, between the flanges 19 on the opposing cross beams 12, between the flanges 19 on the associated main beams 11 and wall mouldings and between the flanges 19 on the associated cross beams 12 and the wall mouldings, respectively, and the access opening 21 is formed in a selected grid of the ceiling framework to thereby form the ceiling wall 13.

Thereafter, the pair of auxiliary beams 14 are bridged between the flanges 19 on the opposing main beams 11 on the inside of the ceiling wall 13 and secured at the ends thereof to the main beams 11 by the fastening means 15.

That is, in the fastening means 15, since the pressure plate 24 and clamping plate 25 are temporarily assembled together by means of the screw 26 and wing nut 27, the hook 31 is fitted on the rectangular bulb 20, the clamping plate 25 is hooked on the associated main beam 11, the bent foot 28 is pressed against the associated auxiliary beam 14 by sliding the pressure plate 24 along the clamping plate 25, the wing nut 27 is fastened to secure the auxiliary beam 14 to the associated main beam 11 and at the same time the auxiliary beam 14 as well as the ceiling wall 13 is pressed against the flange 19 on the associated main beam 11 to thereby finally secure the auxiliary beam 14 to the ceiling framework.

After the auxiliary beams 14 have been secured to the ceiling framework by the fastening means 15 in the manner described hereinabove, the stationary framework 32 having the access door 16 or the movable framework 33 removed therefrom previously is fitted in the access opening 21 and pushed into the access opening 21 until the outwardly extending flanges 41 on the stationary framework 32 abut against the access opening defining edge 22 whereupon the stationary framework 32 is temporarily secured to the auxiliary beams 14 by means of the four mounting means 17.

That is, the hooks 61 are fitted in the grooves 44 by sliding the hooks 61 along the webs 40 on the frame members of the stationary framework 32 fitted in the access opening 21 on the inside of the framework, the carrier plates 59 are hooked on the stationary framework 32 and the stationary framework 32 is temporarily secured to the auxiliary beams 14 by the four mounting means 17 with the leading ends of the threaded clamping bars 60 riding on the auxiliary beams 14.

After the temporary securing of the stationary framework 32 to the auxiliary beams 14 in the manner described above, the threaded clamping bars 60 are turned in the fastening direction to sandwich the access opening defining edge 22 of the ceiling wall 13 between the outwardly extending flanges 41 on the frame members of the stationary framework 32 and the auxiliary beams 14 to thereby assemble the stationary framework 32 to the ceiling framework.

After the assembly of the stationary framework 32 to the ceiling framework in the manner described above, the movable framework 33 having the cover plate 36 attached thereto is inserted into the opening 34 defined by the stationary framework 32 while the shafts 38 are being snapped in the bearings 37 to thereby assemble the movable framework 33 to the stationary framework 32 for rotation relative thereto. Thereafter, the movable framework 33 is rotated upwardly to close the opening 34 defined by the stationary framework 32 and the movable framework 33 and accordingly, the cover plate 36 of the movable framework is locked against the stationary framework 32 by the cremorne lock 39.

Although the ceiling construction 10 is erected on the ceiling of the building room in the manner described above, the ceiling construction may be erected in various different ways depending upon the conditions within the building room or the conditions at the construction site.

FIGS. 6 through 13 show modified fastening means which can be employed in the ceiling construction as shown in FIGS. 1 through 5. In the modified fastening means 70 of FIGS. 6 through 9, the bent foot 28 of the afore-mentioned fastening means 15 has on the upper surface thereof a raised tongue 71 which has been provided by cutting and bending a portion of the foot to the shape as shown in these Figures. By the provision of the tongue 71 on the foot 28, even when the auxiliary beams 14 have a length somewhat shorter than the span between the flanges 19 on a pair of opposing main beams 11, the fastening means 70 can positively secure the opposite ends of the auxiliary beams 14 to the flanges 19 on the main beams 11.

Figure 6:
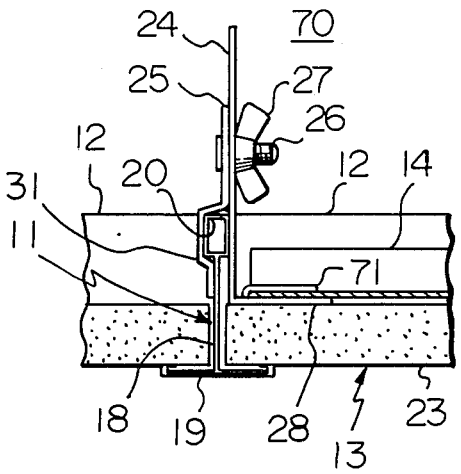
FIGS. 6, 8 and 9 are similar to FIG. 4, but show a modified embodiment of said fastening means shown in FIG. 4.
Figure 7:
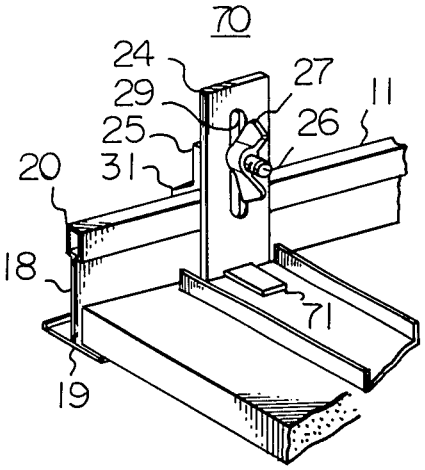
FIG. 7 is a perspective view of said modified embodiment of the fastening means as shown in FIGS. 6, 8 and 9.
Figure 8:
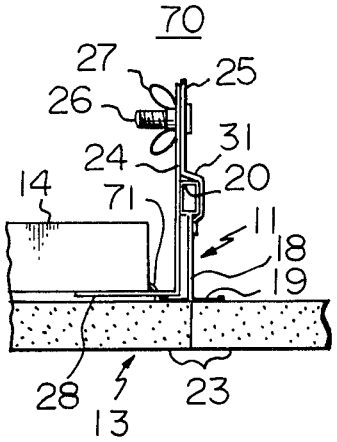
Figure 9:
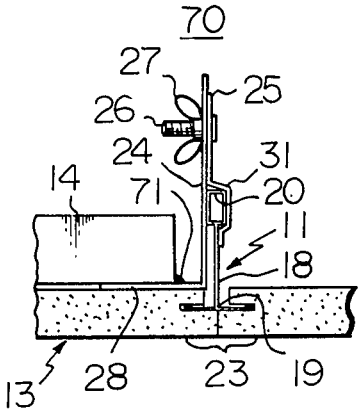

FIGS. 6 and 7 show the modified fastening means 70 as applied to a ceiling construction erected by the exposed construction method, FIG. 8 shows a modified fastening means 70 as applied to the ceiling construction erected by the dry wall construction method and FIG. 9 shows a modified fastening 70 as applied to the ceiling construction erected by the concealed construction method, respectively.

Figure 10:
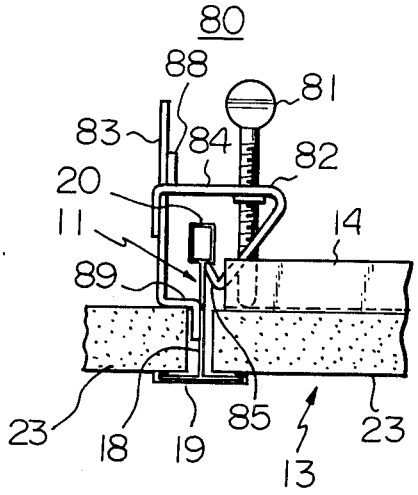
FIG. 10 is similar to FIG. 4, but shows on an enlarged scale a further modified embodiment of said fastening means shown in FIG. 4.
Figure 11:
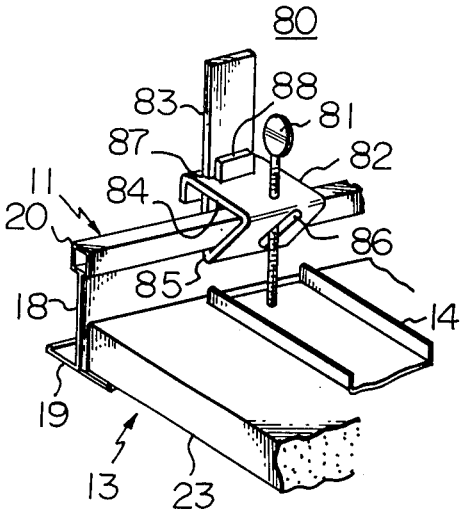
FIG. 11 is a perspective view of said fastening means as shown in FIG. 10.

FIGS. 10 and 11 show a modified fastening means 80 as applied to the ceiling construction erected by the exposed construction method and the fastening means 80 comprises a threaded pressure bar 81 pressing the associated auxiliary beam 14 as well as the ceiling wall 13 against the flange 19 on the associated main beam 11 at the adjacent end of the auxiliary beam 14, a clamping plate 82 having a horizontal arm 84 provided with a threaded hole in threaded engagement with the threaded pressure bar 81 and a hook 85 for engaging the rectangular bulb 20 on the associated main beam 11 and a carrier plate 83 holding the clamping plate 82 on the ceiling wall 13.

The pressure clamping plate 82 has an elongated slot 86 formed in the hook 85 and a slit 87 in the arm 84 for receiving the carrier plate 83. The slit 87 is formed by cutting and bending uprightly a portion of the arm 84 to provide a tongue 88.

And when received in the slit 87, the carrier plate 83 extends uprightly along the upright tongue 88 with the foot 89 on the carrier plate 83 riding on the ceiling wall 13.

With the above-described construction and arrangement of the components of the fastening means 80, the auxiliary beams 14 can be positively secured to the ceiling framework by means of the fastening means regardless of whether the ceiling construction where the fastening means 80 is incorporated is erected by the exposed, concealed or dry wall construction methods.

Figure 12:
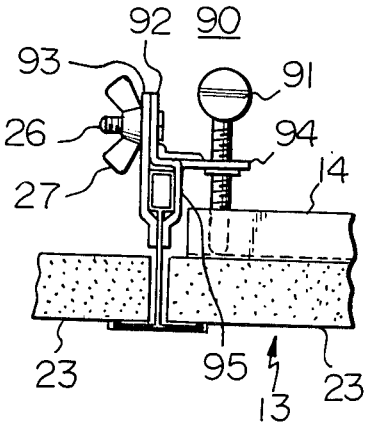
FIG. 12 is similar to FIG. 4, but shows a still further modified embodiment of said fastening means shown in FIG. 4.
Figure 13:
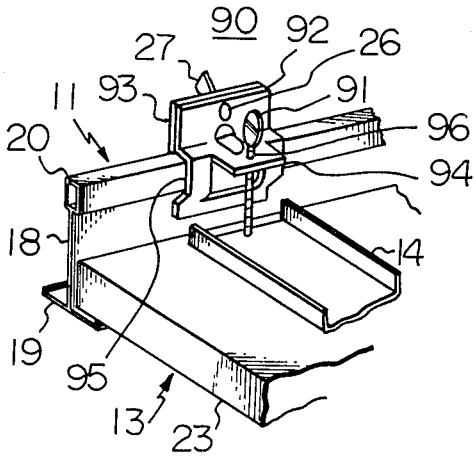
FIG. 13 is a perspective view of said fastening means as shown in FIG. 12.

The modified fastening means 90 shown in FIGS. 12 and 13 is applicable to the ceiling construction erected by the exposed construction method and the fastening means 90 comprises a threaded pressure bar 91 pressing the associated auxiliary beam 14 as well as the ceiling wall 13 against the flange 19 on the associated main beam 11 at the adjacent end of the auxiliary beam 14, a clamping plate 92 having an arm 94 provided with a threaded hole in threaded engagement with the threaded pressure bar 91 and a hook 95 engaging the rectangular bulb 20, an auxiliary plate 92 applied against the clamping plate 92 and a headed screw and wing nut arrangement 26, 27 securing the auxiliary plate 93 to the clamping plate 92.

The arm 94 of the clamping plate 92 is formed by cutting and bending uprightly a portion of the hook 95 and provided with a threaded hole 96 in threaded engagement with the pressure threaded bar 91. The arm 94 is, of course, reinforced with bead.

Like the fastening means 15, the modified fastening means 90 can also positively secure the auxiliary beam 14 to the ceiling construction regardless of whether the ceiling construction is constructed by the exposed, dry wall or concealed construction methods.

From the foregoing description of the invention, it will be understood that as compared with the previously proposed and existing ceiling constructions for buildings, since, in the ceiling construction for buildings according to the present invention, the ceiling framework comprises a plurality of main beams bridging wall mouldings and hung on a plurality of hanger wires or hanger rods and a plurality of cross beams bridging the main beams and the wall mouldings and main beams, respectively, and the ceiling wall is mounted on the ceiling framework to form the access opening in a predetermined position of the ceiling wall, and the auxiliary beams are bridged in a predetermined relationship flanges of the opposite main beams or flanges of the opposite cross beams in the access opening on the ceiling wall, and the fastening means secure the opposite ends of the auxiliary beams to the main and cross beams, and the mounting means secure the access door in the access opening so as to sandwich the access opening defining edge of the ceiling wall between the auxiliary beams and the outwardly extending flanges on the stationary framework, the present invention can be advantageously applied to various ceiling constructions to be constructed by the exposed, concealed and dry wall construction methods, the ceiling construction is reinforced, the ceiling construction is prevented from warping in the horizontal and vertical directions under the load of the access door as the access door is opened and closed, any deflection or strain in the ceiling framework is prevented, even when the access opening where the access door is positioned opens to the ceiling wall, the ceiling wall is positively prevented from lifting from the ceiling framework of the ceiling construction, the ceiling construction is easily applicable to ceiling wall of different thickness and materials and can be constructed in a brief period, and in addition, the ceiling construction gives improved finish to the building ceiling.

As clear from the foregoing description of preferred embodiments of the invention referring to the accompanying drawings, it is to be understood that various modifications and changes will easily occur to those having an ordinary knowledge in the art and the invention can be easily replaced by embodiments which satisfy substantially the same objects as those described hereinabove and attain substantially the same effects as those described hereinabove.

What is claimed is:

1. A ceiling construction for buildings comprising:

a plurality of main beams disposed in a predetermined spaced relationship to each other and positioned for bridging wall moldings opposed and spaced from each other, said main beams including a web, a flange integrally formed with the lower end of the web, and a bulb integrally formed with the upper end of the web;

a plurality of cross beams connected to said main beams in a predetermined spaced relationship to each other at right angles to the main beams so as to form a ceiling framework, said cross beams including a web, a flange integrally formed with the lower end of the web, and a bulb integrally formed with the upper end of the web;

a ceiling wall mounted in said ceiling framework with the upper side of the ceiling wall above the flanges of said main and cross beams in said ceiling framework, said ceiling wall having an access opening therein in a predetermined position between a pair of spaced opposed main beams and a pair of spaced opposed cross beams extending between said pair of main beams;

a pair of auxiliary beams each positioned on the upper side of the ceiling wall and each bridging the flanges of one of a pair of opposed main beams adjacent to and spaced from each other and a pair of opposed cross beams adjacent to and spaced from each other, said auxiliary beams extending along the edges of said access opening;

a plurality of fastening means securing the opposite ends of said auxiliary beams to said pair of beams, said fastening means including a pressure plate engaging said auxiliary beam at the end of the auxiliary beam and pressing said auxiliary beam and the ceiling wall on which it rests against the flange of the corresponding beam of said pair of beams, a clamping plate having a hook for engaging the bulb on said corresponding beam of said pair of beams and engaged with said pressure plate and securing said pressure plate to the web of said corresponding beam, and a screw securing said claimping plate to said pressure plate;

an access door means positioned in said access opening and having a stationary frame having an outwardly extending flange, a movable frame hingedly connected to said stationary frame, and a cover plate fixedly secured to said movable frame; and a plurality of mounting means securing said access door to said auxiliary beams with the outwardly extending flange of the stationary frame against the edge of the ceiling wall which defines said access opening.

2. A ceiling construction as claimed in claim 1 in which said beams have heads along the upper edges, and said fastening means comprises a threaded pressure bar having the end engaging said auxiliary beam and pressing said auxiliary beam and the ceiling wall on which it rests against the flanges of said pair of beams, a clamping plate having an arm thereon through which said pressure bar is threaded, a hook on said clamping plate for engaging under the head of the corresponding beam of said pair of beams, and a carrier plate on which said clamping plate is mounted and holding said clamping plate on said corresponding beam.

3. A ceiling construction as claimed in claim 1 in which said fastening means comprises a threaded pressure bar having the end engaging said auxiliary beam and pressing said auxiliary beam and said ceiling wall on which it rests against the flanges of said pair of beams, a clamping plate having an arm thereon through which said pressure bar is threaded and against one side of the web of the corresponding beam of said pair of beams, an auxiliary plate against the other side of the web of the corresponding beam, and a screw securing the auxiliary plate to the clamping plate so as to clamp the plates to the web.

4. A ceiling construction as claimed in claim 1, in which said pressure plate has a foot for pressing the end of said auxiliary beam and the ceiling wall against one of flanges of the main beams and cross beams.

5. A ceiling construction as claimed in claim 4, in which said pressure plate has a tongue formed of a portion of the foot which has been cut out and bent up from the upper surface of said foot with a space therebetween, the end of said auxiliary beam being received in said space.

* * * * *